United States Patent [19]

Kirma

[11] Patent Number: 5,074,805

[45] Date of Patent: Dec. 24, 1991

[54] TERMINAL CASE FOR PLUG CONNECTORS

[75] Inventor: Safa Kirma, Wedel, Fed. Rep. of Germany

[73] Assignee: MBB GmbH, Bremen, Fed. Rep. of Germany

[21] Appl. No.: 918,610

[22] Filed: Oct. 14, 1986

Related U.S. Application Data

[63] Continuation of Ser. No. 692,367, Jan. 16, 1984, abandoned.

[30] Foreign Application Priority Data

Jan. 28, 1984 [DE] Fed. Rep. of Germany ..... 3402919

[51] Int. Cl.[5] ..... H01R 13/58

[52] U.S. Cl. ..... 439/452; 439/459; 439/470

[58] Field of Search ..... 339/103 R, 103 C, 103 M, 339/101, 104, 107; 439/449, 452, 456, 459, 470, 471

[56] References Cited

U.S. PATENT DOCUMENTS

| | | | |
|---|---|---|---|
| 3,720,906 | 3/1973 | Punako et al. | 339/101 |
| 3,732,527 | 5/1973 | McKnight | 339/103 M |
| 3,792,417 | 2/1974 | Punako | 339/103 M |

*Primary Examiner*—Eugene F. Desmond
*Attorney, Agent, or Firm*—Ralf H. Siegemund

[57] ABSTRACT

A terminal case for straight or angled off cable configuration as it extends from a plug connector, particularly for use in aircraft, is provided to have an integral or separate threaded ring and a transition piece of open cross section having sector-like contour, the sector angle decreases away from the ring towards a cable catch. The purpose thereof is to increase the strength of the configuration so that even if the parts are made of synthetic, strength values become comparable with known terminal cases made of metal.

5 Claims, 2 Drawing Sheets

TERMINAL CASE FOR PLUG CONNECTORS

This is a continuation of application Ser. No. 692,367, filed Jan. 16, 1989, now abandoned.

BACKGROUND OF THE INVENTION

The present invention relates to a terminal case for a plug connection particularly for use in aircraft having a transition arm whose annular end is threaded onto the plug while the other end of the arm is integral with a cable catch or guide.

Terminal cases of the type to which the invention pertains are usually used in cooperation with a threaded sleeve on a plug connector to be connected firmly with the respective cable bundle, whereby the joints of the individual cable or wires are relieved with certainty from tension forces. U.S. Pat. No. 3,603,913 shows a terminal case of this type, whereby particularly a threaded annulus 11 is provided for being fastened to a tension relief element 21 by means of an arm 18. The arm 18, as per that reference, is made in single piece or integral configuration with the threaded annulus 11.

Other solutions for this particular structure are known wherein the arm for the load relief is integrally combined with an annular part which in turn is threaded to the threaded sleeve of the plug connector. The terminal case, in accordance with U.S. Pat. No. 3,603,913, is constructed for an orientation of the cable leading straight away from the plug. In other words, the cable connector runs parallel as far as the cable bundle on one hand, and the axis of the plug on the other hand is concerned.

A case for a bent off cable configuration is illustrated, for example in U.S. Pat. No. 3,732,527. Herein the axis of the cable bundle runs perpendicular to the axis of the plug. The cable bundle 41 in this particular patent is held by an arm 32 which is provided in single piece configuration with a tubular part 31. The latter is fastened through cap screw 20 to the threaded sleeve of the plug.

The terminal cases for such plug generally have to be quite strong. Standards here are provided, for example, in MIL-C 85049, and the elements referred to above, such as 18 and 32 are made, for example, of metal such as a lightweight metal alloy. The standard refers also to cases made of a synthetic, but particular strength values are not listed here. Cases made of metal have, however, the following drawbacks: First of all, the manufacture is rather complex, but, most importantly, they are relatively heavy. This is a feature which becomes noticeable in aircraft having, for example, a very large number of such connectors.

DESCRIPTION OF THE INVENTION

It is an object of the present invention to provide a terminal case or box of the type referred to above, but being characterized by simpler manufacturing techniques and low weight whereby, however, the standards as set forth above and particularly concerning principal dimensions and strength values for metal case are maintained.

In accordance with the preferred embodiment of the present invention, a terminal case or casing is suggested for threaded attachment to a plug connector particularly of the type that is used in aircraft. This case is comprised basically of two parts: A threaded annular part and a transition piece to a cable catch, the transition piece and the annular part may be integral or separate but connected to each other in a detachable fashion. The transition piece is primarily characterized by a profile of an open cross section defined by segments of the sector type, preferably annular sectors but V and U shaped sectors are possible; in all instances the sector angle decreases from a maximum value adjacent to the threaded annular part towards a minimum value adjacent the cable catch. The peripheral contour of this transition piece is preferably of a near parabolic configuration which, in a simplified version, may be approximated by a linear version. The sector angle may have a maximum value between 100 and 300 degrees, and a minimum value between 20 and 90 degrees. In the preferred form, the threaded annular portion is rotatably affixed to the transition piece by means of a collar and edge arrangement adjacent its maximum sector angle portion. This threaded annulus or sleeve may have an outer diameter which is constant or decreases in the direction away from the transition piece. The same rule applies if the threaded annulus is an integral part of the transition piece. In case of a separate annulus, it may have an edge gripping around and behind a collar of the transition piece, and that edge may have increasing wall thickness in radial direction.

DESCRIPTION OF THE DRAWINGS

Proceeding now to the detailed description of the drawings, FIGS. 1 and 2 illustrate the terminal case for a plug connector which is not shown by itself, but represented by the axis A. The case is basically comprised of a particularly contoured part 1, to be described in detail below, combined (assembled) with a cap screw or sleeve nut 2. However, sleeve 2 can rotate independently from part 1. Part 1 is made of a synthetic, and includes an annular or ring-shape part 3, a transition piece or arm 4, and a cable catch 5 having an outer bead 6. The annular part 3 is provided on its outside with a collar 7 having spline teeth 8 where facing the plug connector. The nut or cap 2 has an inner thread 9, as well as a ring or ledge 10. When inserted, part 1 is attached by abutment to the plug connector and is connected thereto through the nut 2 because the ring 10 of the nut 2 abuts the collar 7 of part 1.

Figure 1:
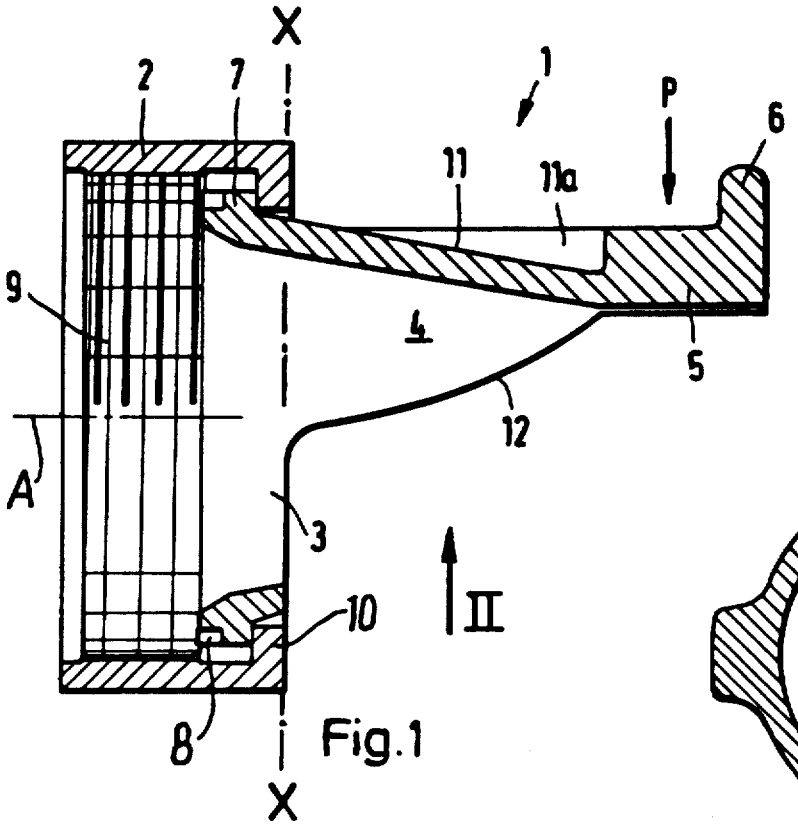
FIG. 1 is a longitudinal section view through a terminal case constructed in accordance with the preferred embodiment of the present invention for practicing the best mode thereof, and being provided for receiving a cable bundle whose axis runs parallel to the plug axis.

A cable bundle projects from the plug connector, and is run through the annulus 2 and annular part 3, and is fastened through conventional cable fasteners to the cable catch 5. Any sliding off of the cable fastener is prevented on one hand through the bead 6, and on the other hand through the strongly widened transition piece 4. Transition piece 4, is for practical purposes, a bending carrier clamped and tensioned at the location or plane X. In accordance with the above-mentioned standard, this transition piece has to be able to withstand a load P of particular value as it will be acting upon the cable catch 5. In order to obtain a sufficiently high resistance moment, the cross section of the transition piece 4 is constructed in ring sector configuration as far as cross-section is concerned, whereby the center angle alpha steadily drop from a maximum value near the clamping area or point X towards a minimal value near the cable catch 5.

The transition piece 4 can be considered basically to be a conical tube or sleeve. Consequently a conical wall 11 is established being reinforced by a rib 11*a* having a width equal to the width of the cable catch 5. The transition piece 4, therefore, is constructed as a body of uniform strength i.e. the bending moment divided by the resistance moment in any cross-section (FIG. 3*a*, *b* or FIG. 6*a*,*b*) is constant, except for certain boundary zone between the cable catch and the transition piece 4 itself. Consequently, the contour of the edge 12 of the transition piece 4 is approximately parabolic. The contour as seen in FIG. 2 follows from this configuration.

Figure 3A:
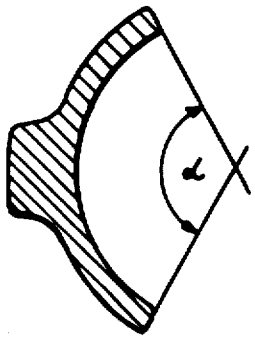
FIG. 3*a* and 3*b* are respectively section views in accordance with IIIa and IIIb, as shown in Pig. 2.
Figure 2:
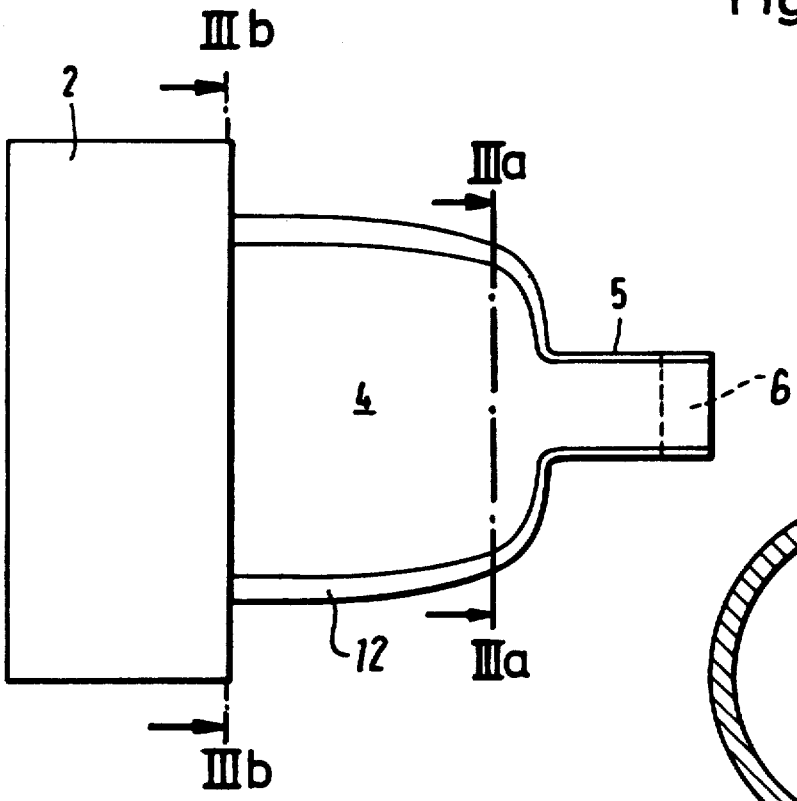
FIG. 2 is a view as indicated by II in FIG. 1.
Figure 3B:
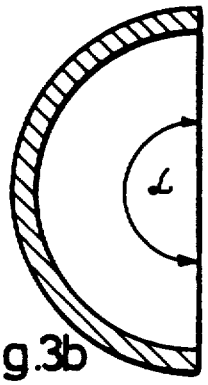

FIGS. 3*a* and 3*b*, as stated, show, respectively, cross-sections (IIIa and IIIb) as indicated in FIG. 2. These cross sections through the wall of the transition piece 4 are therefore of ring sector configuration with a variable center angle alpha. As can be seen from a comparison between FIG. 3*b* and FIG. 3*a*, that center angle alpha is about 180 degrees in the fastening plane X and drops to a smaller value towards the catch portion 5 of the part 1.

Figure 5:
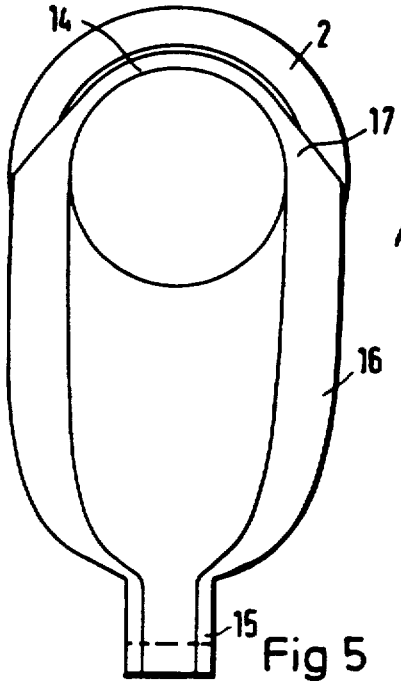
FIG. 5 is a view as indicated by V in FIG. 4.
Figure 4:
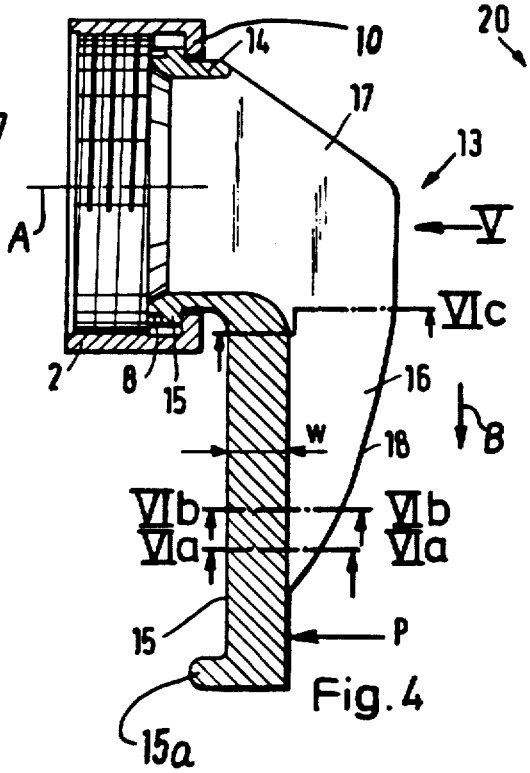
FIG. 4 is a section view similar to FIG. 1, still constituting an example of the preferred embodiment for practicing the best mode of the invention, but in an environment requiring a bent off cable configuration as far as and in relation to the axis of the plug is concerned.

FIGS. 4 and 5 essentially show a modification of the case shown in FIGS. 1 through 3*b*, the modification involving specifically adaptation to the reorientation of the axis of the cable bundle. The axis A again constitutes the axis of the plug connector to which the nut element 2 is connected. The axis or direction B in turn indicates the direction into which the cable bundle is to be deflected. The nut part 2 is similar to the one shown in FIG. 1, but the part 13, taking the place of part 1 in FIG. 2, is different. Again, of course there is an annular portion 14 affixed through a collar 15 to the annulus 2 (ledge 10) just as described above with reference to FIG. 1. Also, there is provided a cable catch, denoted here by reference numeral 15, having a bead 15*a*. Corresponding to the redirection of the cable bundle to be accommodated, the longitudinal extension of the cable catch 15 establishes an angle by 90 degrees with the axis A of the plug connector being also of course the axis of the ring 2 when connected to the plug connector.

The load P acting on the cable catch 15 is effective through a transition piece 16 and an angle piece 17 extending towards the collar 15 to react that force into the nut 2. The transition piece 16 is particularly sensitive against bending, but is constructed to be of uniform strength by having a ring sector cross section varying, as far as the center angle alpha is concerned, in a manner analogous to the variation described above.

Figure 6A:
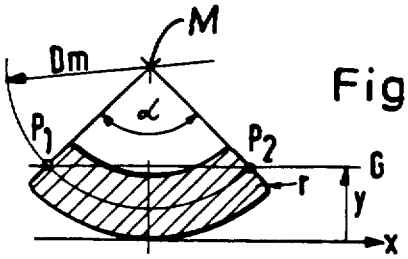
FIGS. 6*a*, 6*b* and 6*c* are respectively section views as indicated by VIa, VIb, and VIc in FIG. 4.

The transition piece 16, as shown in FIG. 4, has again parabolic contour in projection. The starting point here is a cylindrical tube with a wall thickness W, out of which the contour is, so to speak, cut. FIG. 5 illustrates a side view contour of this transition piece 16. FIGS. 6*a*, *b* and *c* show, respectively, the variation of the center angle alpha, the sections being taken in the planes VIa, VIb, and VIc, as indicated in FIG. 4, and one can see, so to speak, the progression from the extremity of the catch 5 towards the annular portion 14 of this transition piece 13. The geometries can be discerned in detail from these FIGS. 6*a*, *b* and *c*.

For constructing these local cross sections, one begins with a suitable tube having a wall thickness W, and through strength value calculation a value y is ascertained, denoting a particularly distance from the X axis. This axis X is drawn tangentially through a point of the tube. As shown in FIGS. 6*a*, *b* and *c*, different values y are ascertained here with regard to different locations, and for each of them a straight line G is plodded parallel to the X axis. A circle around the center or center axis M of the tube with a diameter DM cuts or intersects the respective line G in points P1 and P2. These points of course are different for the different FIGS. 6*a*, *b* and *c*. The trace P1-M-P2 defines the local center angle alpha. The individual sectors are, in a peripheral direction, bounded by hypothetical legs spread apart by the respective angle alpha so ascertained. The resulting edges are rounded by means of radii r.

Figure 7A:
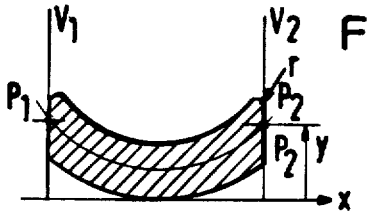
FIGS. 7*a*, 7*b* and 7*c* illustrate different cross-sectional contours of a threaded sleeve used in any of the devices shown in the preceding figures.
Figure 6B:
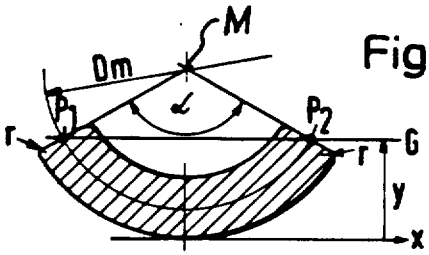

FIGS. 7*a*, *b* and *c* illustrate other conceivable cross section of a transition piece. The annular segment in accordance with FIG. 7*a* is limited in a peripheral direction through two straight lines V1 and V2 running parallel t the Y axis, and through the points P1 and P2. Herein the edges are again rounded, as indicated by radius r.

Figure 7B:
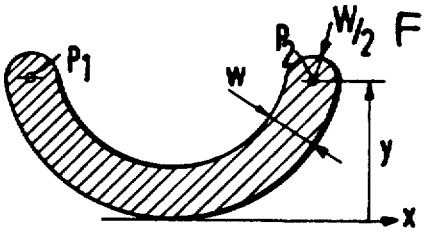
Figure 6C:
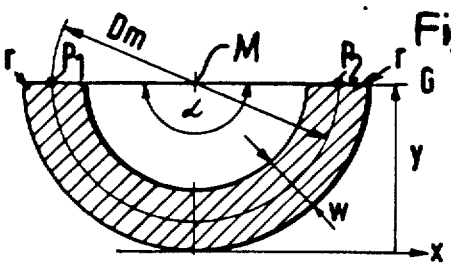
Figure 7C:
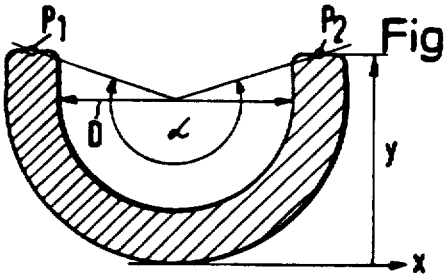

The ring or annular sector in accordance in FIG. 7*b* is limited in peripheral direction through arcs around the point P1 and P2 with a radius W/2. In the case of making a terminal case of the type shown in FIG. 4, i.e., with angled off cable guidance, a center angle alpha larger than 180 degrees offers the advantage particularly in the manufacturing of the part, and here particularly for the contour of the die casting mold if one chooses a cross section in accordance with FIG. 7*c*. In this case, i.e., for this particular cross section, wall parts situated above the horizontal diameter line D are continued parallel to the Y axis in up direction, up to the particular value y. The upper boundaries of the wall may differ but these figures show a preferred form for curving radius r. In all these examples, as per FIG. 7, it can be said that eventually casting inclinations can be provided, and the curving radii r should be not larger than W/2.

Figure 8:
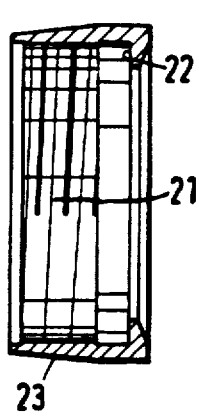
FIG. 8 is an axial section through such threaded sleeve.

FIG. 8 illustrates a section through a cap screw or sleeve nut of the type generally as used above and generally identified here with reference numeral 20, but to be used in the alternative to the particular nut 2. Again, there is shown an inner threading 21 and a radially inwardly oriented ledge 22, whereby particularly the originally essentially cylindrical nut is provided with a conical outer contour 23. This contour results from an attempt to distribute the effective load upon the individual threadways in at least approximately equal fashion. The ring or ledge 22 has therefore a wall thickness which increases in radial direction. This way one obtains within the ring 22 approximately a uniform bending strength. Moreover, this feature reduces those areas of rings of the known variety which are loaded only relatively little as far as material is concerned. This in fact reduces the amount of material used, and therefore reduces the weight of such a part. The saving in weight for an individual sleeve nut may be minimal, but since, as stated, many of these type of connectors are used in an aircraft, the total amount of weight saving by such a seemingly minor feature can be considerable.

The prescribed shape of the nut (2, 20) is applicable in principle, even in those cases in which the nut itself is really of single piece configuration with the transition part. In such a case, not illustrated here, one can consider 1 or 13 and 2 to be of integral configuration, which means that the annular part of the part 1 or of part 13 is provided with an internal threading, and permits therefore direct threading onto the threaded sleeve part of the plug connector. Such a configuration is particularly meaningful in those cases where the cable is run straightaway from the plug connector, such as shown in FIG. 1.

The transition piece generally is shown above in the various examples in forms of sequence of variable-angle-type ring sectors. The principle employed here can be maintained even if other types of open profiles are used, such as a V-shaped or U-shaped section.

In view of the particular contour and shape of the parts involved, and here particularly the part 1 and 13 on one hand, and of the sleeve nut on the other hand, one obtains very advantageous strength values if one uses, for example, a synthetic such as polyetherimid or polyamidimid. This means that the standards mentioned above and applicable to metallic cases are attainable with these synthetic materials if configured in accordance with the present invention. However, the contours outlined above are by no means inherently limited to the utilization of synthetic material. Rather, all of the parts illustrated above can be made of metal. A still further modification is conceivable in that the sleeve nut such as 20, in accordance with the invention, can be used per se in conjunction with an appropriately contoured plug connector without the transition piece.

The invention is not limited to the embodiments described above, but all changes and modifications thereof not constituting departures from the spirit and scope of the invention, are intended to be included.

What is claimed is:

1. Terminal case for connection to a plug connector having a threaded annular portion (3) for threading onto the plug connector, comprising:

a transition piece (4) of open construction and cross section, and having a sector angle having its maximum value adjacent said annular portion, said sector angle decreasing in value steadily in a direction away from said annular portion to a minimum value such that a peripheral contour (12, 18) of said transition piece from the area of maximum sector angle to the area of minimum sector angle is not a straight line but outwardly bulging at at least approximately a parabolic contour (12) so that in every said cross-section the ratio given by the bending moment divided by the resistance moment is substantially constant to approximate uniform strength;

a cable catch extension extending from the transition piece adjacent the area of minimum sector angle; and said annulus and said transition piece with cable catch extension being made of a non-metal synthetic material.

2. In a case as in claim 1 wherein the maximum angle of said sector angle is between 100 and 300 degrees, and said minimum angle is between 20 and 90 degrees.

3. Case as in claim 1 wherein said threaded annular portion is a separate sleeve nut rotatably attached to an annular end portion of said transition piece.

4. Case as in claim 1 wherein the outer diameter of said threaded annulus decreases in the direction away from said transition piece.

5. In a case as in claim 3, said sleeve nut having a retaining ledge cooperating with a collar at an annular end piece of said transition piece, the collar having a wall thickness increasing in radially outer direction.

* * * * *